US005560401A

United States Patent [19]

Miglus

[11] Patent Number: 5,560,401

[45] Date of Patent: Oct. 1, 1996

[54] ANIMATED MULTI-IMAGE FABRIC AND METHOD OF PRODUCING THE SAME

[76] Inventor: Wanda M. Miglus, 408-A Grove St., Greenwood, S.C. 29646

[21] Appl. No.: 469,229

[22] Filed: Jun. 6, 1995

[51] Int. Cl.[6] ..... D03D 13/00

[52] U.S. Cl. ..... 139/383 R; 428/913.3; D5/99; 139/416; 139/417

[58] Field of Search ..... 428/225, 913.3; D5/20, 47, 49, 99; 2/243.1, 115; 139/388 R, 416, 417

[56] References Cited

U.S. PATENT DOCUMENTS

| | | | |
|---|---|---|---|
| 3,767,399 | 10/1973 | Takano et al. | 430/2 |
| 4,000,342 | 12/1976 | Rochelle et al. | D5/99 |
| 4,838,965 | 6/1989 | Bussard | 2/115 |
| 5,227,220 | 7/1993 | Biedermann | 428/913.3 X |
| 5,239,396 | 8/1993 | Thompson | 359/1 |
| 5,314,767 | 5/1994 | Bussard | 430/1 |

FOREIGN PATENT DOCUMENTS

| | | | |
|---|---|---|---|
| 3294545 | 12/1991 | Japan | 139/416 |
| 1730245 | 4/1992 | U.S.S.R. | 139/416 |

*Primary Examiner*—Andy Falik
*Attorney, Agent, or Firm*—Davis, Bujold & Streck, P.A.

[57] ABSTRACT

A fabric having two images on a front surface thereof. The images are defined by a plurality of parallels, alternating, upper pairs and lower pairs of weft yarns. The upper pairs forming ridges defining the images and the lower pairs forming valleys between each adjacent pair of ridges. A first of the two images being visible when viewing the front surface at an angle from a first direction and substantially invisible when viewing the front surface at angle from a second direction. A second of the two images being visible when viewing the front surface from the second direction and substantially invisible from the first direction. The invention also provides a process for producing the fabric.

17 Claims, 5 Drawing Sheets

ANIMATED MULTI-IMAGE FABRIC AND METHOD OF PRODUCING THE SAME

FIELD OF THE INVENTION

This invention pertains to a method of weaving a fabric having a weave structure that incorporates two separate images into a single layer fabric, such that both images appear on the face of the fabric and each image can be seen independently of the other depending upon the angle at which the fabric is being viewed, and to a fabric produced according to the method.

BACKGROUND OF THE INVENTION

There exist various prior art fabrics containing virtually any desired image on the front and/or rear surface of the fabric. The prior art fabrics are produced by a variety of weave patterns, ranging from relatively simple weave structures to very complex weave structures.

Until the present invention, however, there has not existed a fabric that contains two images on a first surface thereof, one of which is only visible upon viewing the fabric at a first angle and the other of which is only visible upon viewing the fabric from a second angle.

It is an object of the present invention to provide a method of producing an animated fabric in which one image is visible from a first angle and a second image is visible from a second angle.

It is also an object of the invention to provide an animated image fabric as described above.

SUMMARY OF THE INVENTION

The objects of the invention are achieved by weaving the warp yarns, which run horizontally in the drawings, with the weft yarns, which run vertically in the drawings, such that the warp yarns force the weft yarns into a corrugated configuration of vertical, minute parallel ridges and valleys. The front face of the fabric is a continuous field of vertical parallel ridges and valleys spanning the full width of the fabric.

Upon viewing the face of the fabric at an angle relative to the plane of the face of the fabric, i.e. off to one side of the ridges, a first side of the ridges is visible and the opposite, second side of the ridges is obscured from view. Upon viewing the fabric at an angle off to the opposite side of the ridges, the second side of the ridges is visible and the first side of the ridges is obscured from view.

The process according to the invention takes advantage of the above phenomenon by forming one side of the ridges with weft yarns that define a first of the two images and forming the opposite side of the ridges with weft yarns that define the second image.

BRIEF DESCRIPTION OF THE DRAWINGS

The invention will now be described, by way of example, with reference to the attached drawings, in which.

DETAILED DESCRIPTION OF THE PREFERRED EMBODIMENT

Figure 1:
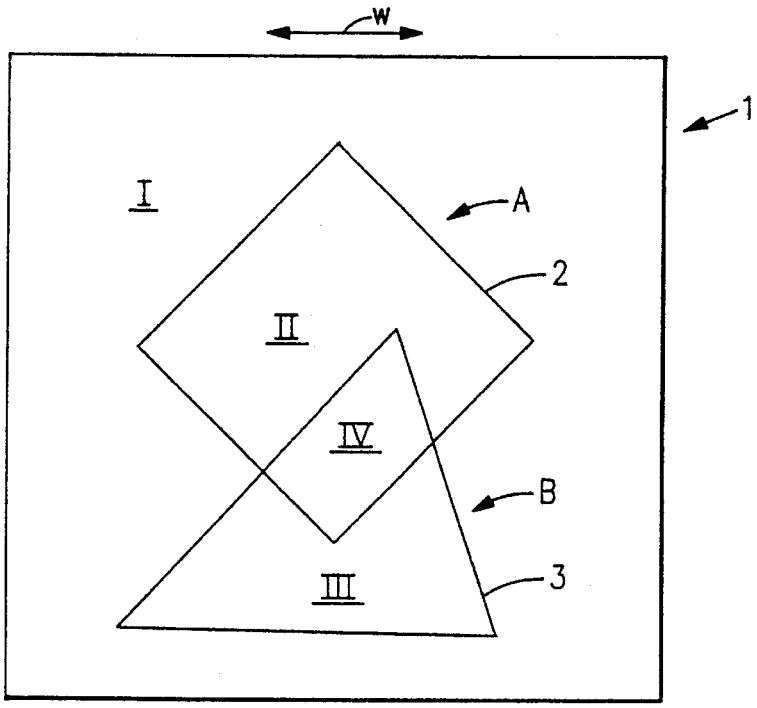
FIG. 1 is a diagrammatic illustration of a fabric 1 according to the invention having two overlapping images A and B.
Figure 2:
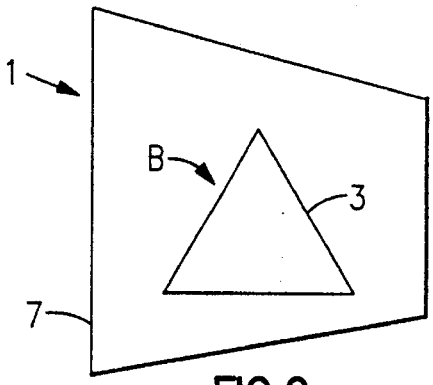
FIGS. 2 and 3 are diagrammatic illustrations, respectively illustrating that only a second of the images B is visible from the left and a first of the images A is visible when viewing the fabric 1 from the right.
Figure 3:
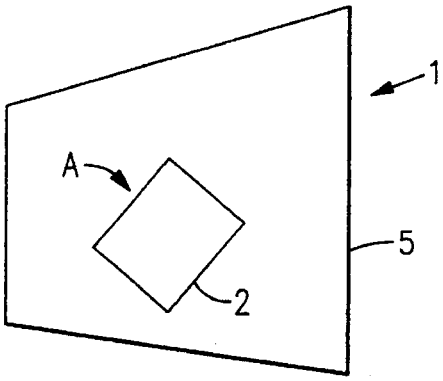

The weave structure of the fabric according to the invention, generally designated as 1, can be divided into opposed pair of interlace patterns that, respectively, define an image A, e.g. a square on a background, and an image B, e.g. a triangle on a background. Each image is a simple delineation of a foreground 2, 3 and background relationship. For example, image A consists of a dark foreground 2, e.g. the triangle, on a light background or visa versa.

In order to enhance the effect of the ridges 20 and valleys 22 and sharpen the visual phenomena, contrasting colors, surface textures and/or reflectivity are assigned to the yarn representing the image and the yarn representing the background of each image. Contrasting colors, reflectivity and textures create a clear difference between the raised and recessed rows of threads and clearly define the two images.

The interlace pattern defining the first image A is assigned to the odd numbered weft yarns 11, 13 and the interlace pattern defining the second image B is assigned to the even numbered weft yarns 12, 14. Thus, an odd numbered interlace pattern defines one image and its even numbered counterpart defines the other.

In the illustrated fabric 1, the two images A and B are superimposed onto one another. The overlapping of the foregrounds of the two images creates four distinct areas I, II, III, and IV in the weave structure of the fabric 1. Each area I, II, III, and IV is characterized by a corresponding weave pattern. Each of the four weave patterns is woven in a distinctive repeating structural unit. These four structural units make up the total weave structure of the fabric. Each of these four units, by virtue of the overlapping, is comprised of both the odd and even numbered warp yarns.

To be translated into the weaving process, the total number of weft yarns required to weave the full image A, B, from one side of the fabric to the opposite side is determined. The individual images A and B are then broken down into a plurality of vertical strips or columns, which together equal the total number of weft yarns required to form the total image A, B. These vertical strips of the images are merged together such that the odd numbered strips define the first image A and the even numbered strips define the second image B.

The weft yarns are then collated such that they correspond to the merged vertical strips, e.g. such that the odd numbered weft yarns define the first image A and the even numbered weft yarns define the second image B. Therefore, the process is the collated weaving sequence of these yarns.

The pattern of the collated weaving sequence is based on a repetition of eight interlace positions, bottom to top and side to side, accounting for weft yarns 11–14 and warp yarns 31–38, in order to facilitate the weaving of the fabric 1 on a loom, such as a Jacquard loom, for example. The total number of weft 11–14 and warp 31–38 yarns of the collated images A and B is therefore divisible by eight.

The collation of the yarns of the images A and B defines the four distinct repeating structural units of the weave pattern that correspond to and create the four areas I, II, III, IV in the fabric 1. The relationship of one structural unit to another and to their location in the combined image A, B is determined by where the foregrounds 2, 3 and backgrounds of the two images A and B are located on the fabric 1 and where they overlap. When the two images A and B are woven together the unique phenomena of this weave structure is created.

The corrugated ridged effect, described earlier, is created by weaving alternating pairs of weft yarns located in a foreground upper plane 18, that is parallel to the face of the fabric, and pairs of weft yarns located in a background lower plane 16, that is also parallel to the face of the fabric 1. Each of these pairs is made up of a weft yarn 11–14 representing each image A and B.

The upper and lower pairs of weft yarns are woven in a different repeating pattern within each area I, II, III, IV of the fabric 1, as set forth in detail below, such that the ridges 20 and valleys 22 display one image A from a first angle X, and the other image B from a second angle Y. The viewing angle X or Y typically forms an angle relative to the plane defined by the fabric 1 of preferably from 20 to 70 degrees, more preferably 40 to 60 degrees, or most preferably 50 degrees.

WEAVE STRUCTURE THAT IS COMMON TO EACH AREA I, II, II, IV

Figure 4:
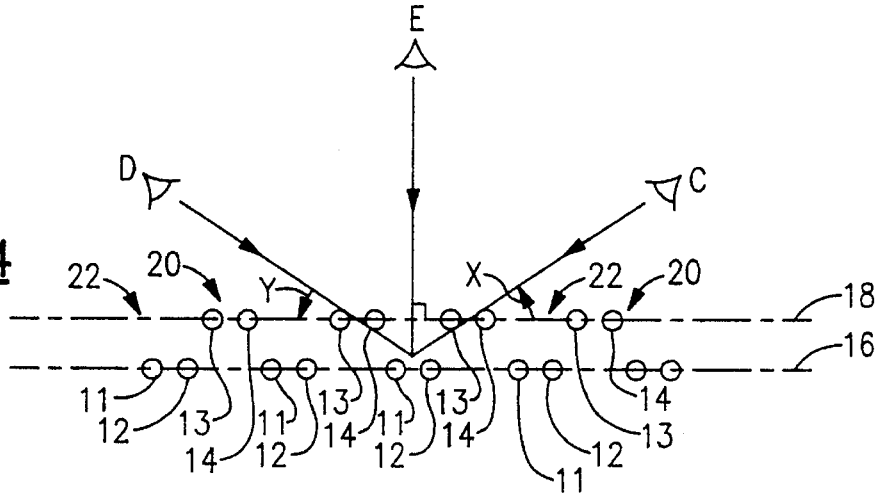
FIG. 4 is a diagrammatic illustration of the two planes 16, 18 of the fabric that define the ridges 20 and valleys 22 and how only one side of the ridges 20 is visible when viewing the fabric of FIG. 1 from the right and only a second side of the ridges is visible from the left.
Figure 5:
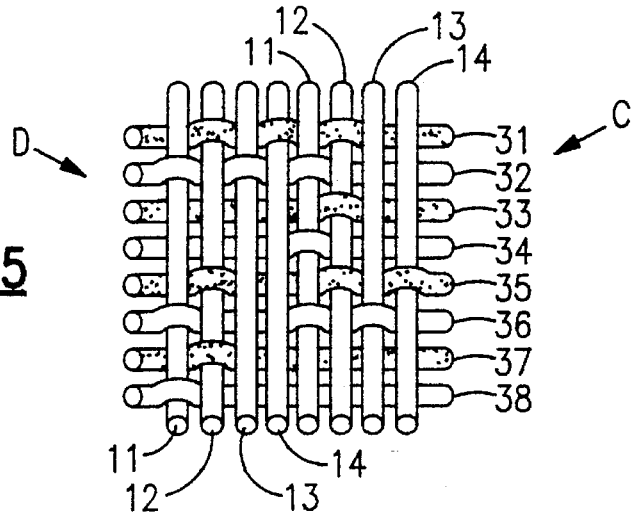
FIGS. 5–9 are diagrammatic illustrations of the weave pattern in a first area of the fabric that does not contain either image.
Figure 6:
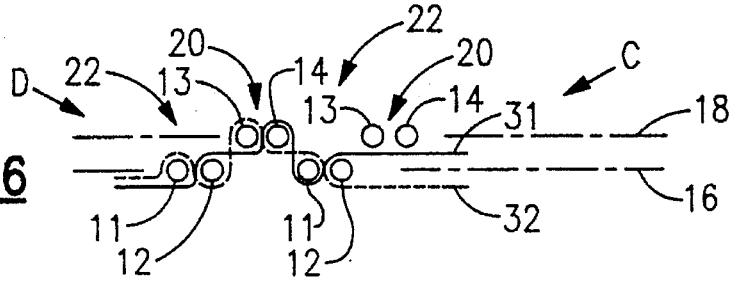
Figure 7:
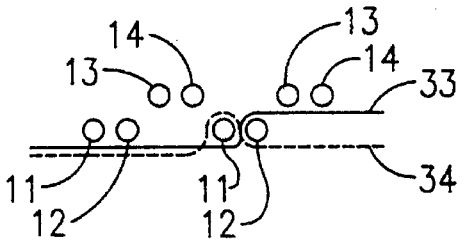
Figure 8:
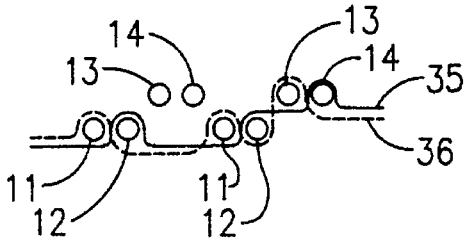
Figure 9:
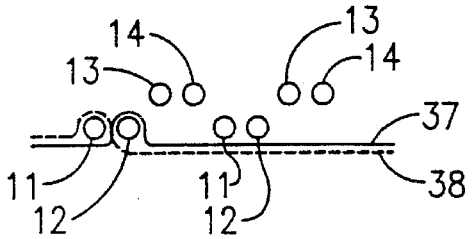
Figure 10:
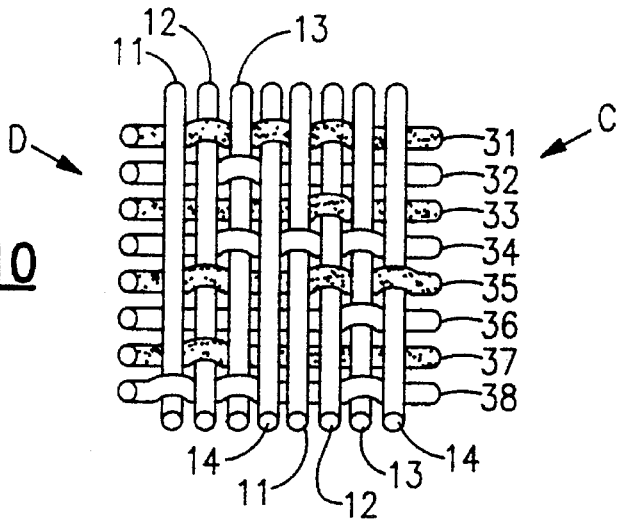
FIGS. 10–14 are diagrammatic illustrations of the weave pattern in a second area of the fabric containing the first image A only.
Figure 11:
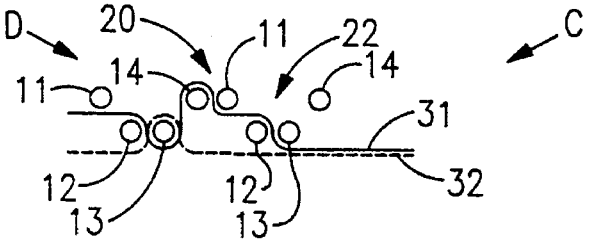
Figure 12:
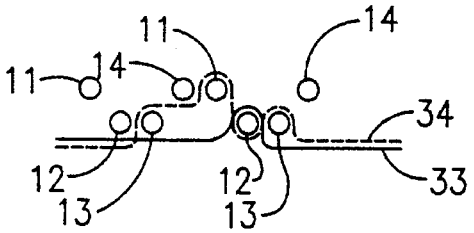
Figure 13:
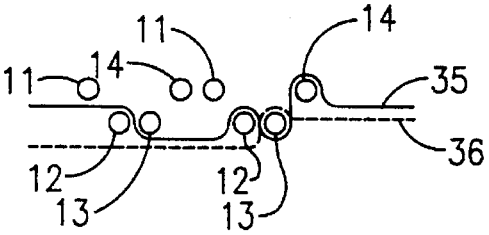
Figure 14:
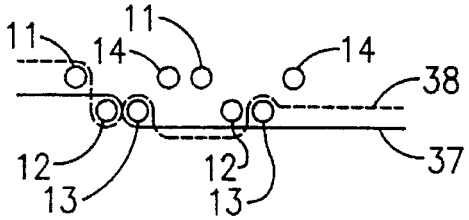
Figure 15:
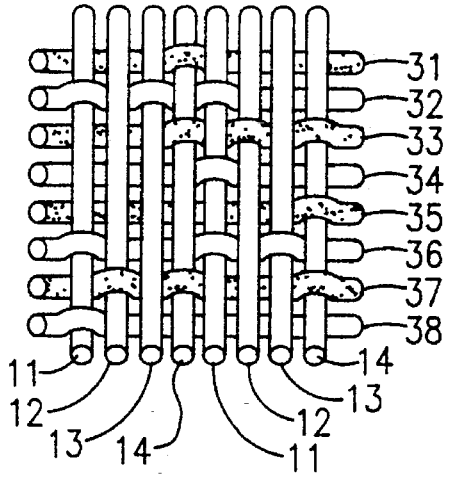
FIGS. 15–19 are diagrammatic illustrations of the weave pattern in a third area of the fabric containing the second image B only.
Figure 16:
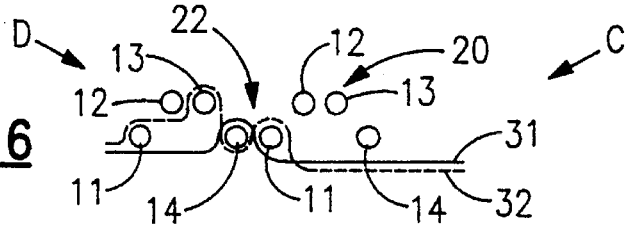
Figure 17:
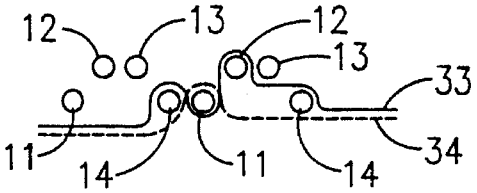
Figure 18:
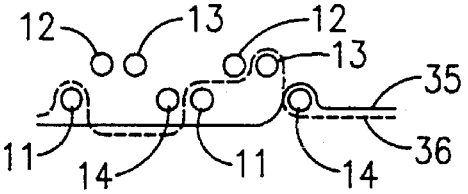
Figure 19:
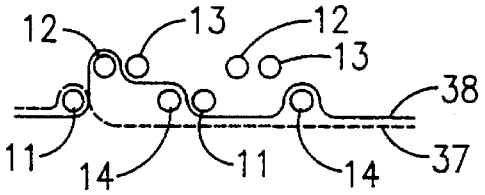
Figure 20:
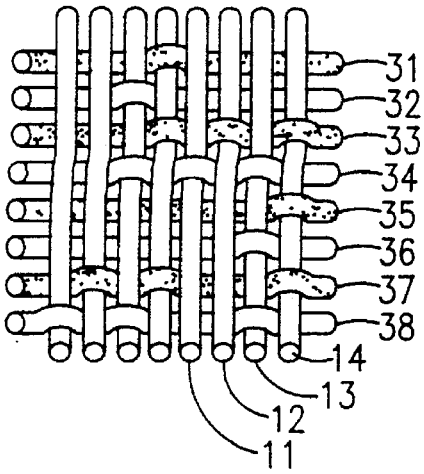
FIGS. 20–24 are diagrammatic illustrations of the weave pattern in a fourth area of the fabric where the two images A and B overlap.
Figure 21:
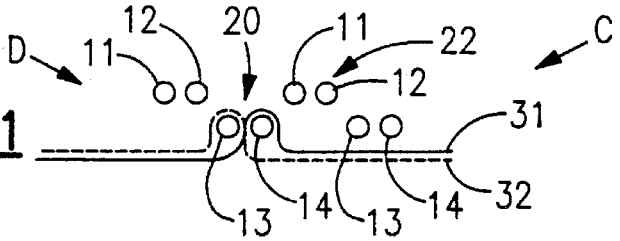
Figure 22:
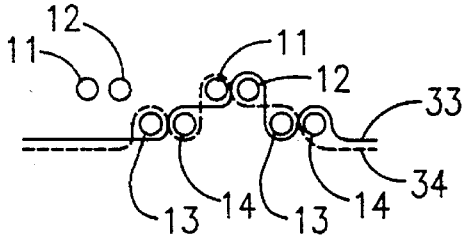
Figure 23:
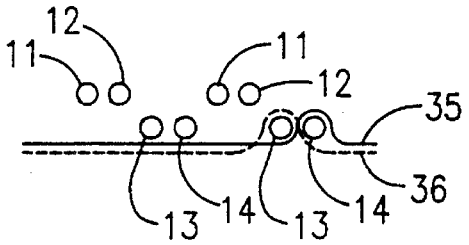
Figure 24:
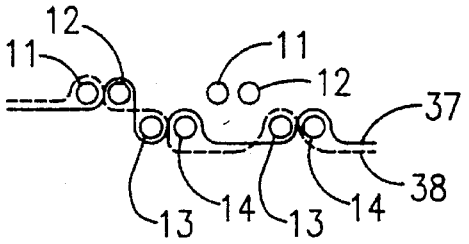

The weft yarns 11–14 are collated such that there is a basic repeating pattern of eight weft yarns that is repeated throughout the four areas I–IV of the fabric. Particularly, as shown in FIG. 4, the weft yarns repeat the following sequence twice in each eight yarn repeat: (1) the first weft yarn 11 in the sequence is of a color that defines the foreground 2 of the first image A, (2) the second weft yarn 12 is of a color that defines the foreground 3 of the second image B, (3) the third weft 13 yarn is of a color that defines the background of the first image A and (4) the fourth and last yarn 14 in the basic weft yarn repeating pattern is of a color that defines the background of the second image B.

As set forth above, each of the four areas I–IV of the fabric are defined by a corresponding repeating structural unit. In each of the structural units, a different pair of the four weft yarns 11–14, are raised to define the ridges 20. The image(s) that is (are) contained in each given areas I–IV determines which two of the four 11–14 weft yarns are raised to form the ridges.

The warp yarns primarily run along the rear surface of the fabric 1 perpendicular to the weft yarns 11–14 and are interlaced with the weft yarns 11–14 in a pattern that repeats every eight warp yarns.

The precise weave pattern may vary from that illustrated in the drawings without affecting the distinctive features of the invention. It is only critical that the warp yarns are interlaced with the weft yarns in a manner that creates the ridges 20 and the valleys 22 as described below.

The two planes 16 and 18 formed in the surface of the fabric 1 defining the ridges 20 and valleys 22 are created in each of the four areas I, II, III, and IV of the fabric, by more tightly and more frequently tying down the weft yarns defining the valleys 22 with the warp yarns 31–38 than the weft yarns defining the ridges 20. Thus, the weft yarns creating the ridges 20 are allowed to nest higher than the weft yarns defining the valleys 22.

In the basic repeating pattern of the preferred eight yarn repeating weave structure, three of the warp yarns 31–38 tie down each of the lower weft yarns 11—14, while only one warp yarn 31–38 ties down each of the upper weft yarns 11–14, see FIGS. 5 through 24. The preferred weave pattern for forming the ridges 20 and valleys 22 in each of the four areas is readily apparent from FIGS. 5–24 and is therefore not described in detail. The nature of this tie down structure also creates an increased tension on the interlace pattern, thereby forcing the weft yarns into a more erect state than in customary interlace patterns.

As shown in FIG. 4, when viewing the fabric 1 from a first direction C (i.e. from a first side 5 of the fabric 1) or a second direction D (i.e. from a second side 7 of the fabric 1), respectively at angles X and Y, both of approximately 20 to 70 degrees, more preferably 40 to 60 degrees, or most preferably 50 degrees and both perpendicular to the weft yarns 11–14, the weft yarns 11 and 12 defining the valleys 22 are obstructed from view by the weft yarns 13 and 14 defining the ridges 22.

When viewing the fabric from the first direction C, the viewer primarily views the weft yarn 14 defining the side of the ridge 20 facing the viewer (i.e. the side facing the first side 5 of the fabric 1). Therefore, the viewer only see the image or background, as the case may be, that is defined by the weft yarn 14. Whereas, when viewing the fabric 1 from the second direction D, the viewer primarily views the weft yarn 13 defining the side of the ridge 20 facing the viewer (i.e. the side facing the second side 7 of the fabric 1). Therefore, the viewer only see the image or background, as the case may be, that is defined by the weft yarn 13. Finally, when viewing the fabric straight on, e.g. in a direction E that is normal to the surface of the fabric 1, all of the weft yarns 11–14 are visible. Therefore, the viewer sees both images. Thus the image that the viewer sees depends upon the angle at which the viewer is viewing the fabric 1.

WEAVE STRUCTURE OF AREA I

FIGS. 5 through 9 diagrammatically illustrate the repeating structural unit of the weave pattern in area I of the fabric 1.

As shown in FIG. 1, neither image A or B is contained in area I of the fabric. Therefore, the first 11 and the second 12 weft yarns, which respectively define the foreground 2 of the first image A and the foreground 3 of the second image B, are located at the lower plane 16. While, the third 13 and fourth 14 weft yarns, which respectively define the backgrounds of the first and second images A and B, are located at the upper plane 18. Thus the third 13 and fourth 14 weft yarns define the ridges 20 and the first 11 and second 12 weft yarns define the valleys 22.

When the first area I of the fabric is viewed from the first direction, as indicated by arrow C, the valleys 22 are obscured from view by the ridges 20. Thus the first and second weft yarns 11 and 12, and therefore the first and second images A and B, are not readily visible from the first direction. The valleys are likewise obscured from view and the images A and B are not readily visible when viewing the first area I from the second direction, arrow D.

FIGS. 6–9 diagrammatically illustrate the precise interlace pattern of the eight warp yarns 31–38 with the eight weft yarns 11–14, 11–14.

WEAVE STRUCTURE OF AREA II

FIGS. 10 through 14 diagrammatically illustrate the repeating structural unit of the weave pattern in area II of the fabric 1.

As shown in FIG. 1, only image A is contained in the fabric in area II. Therefore, the second 12 and third 13 weft yarns, which respectively define the foreground 3 of the second image B and the background of the first image A, are located at the lower plane 16 and define the valleys 22, see FIGS. 10 and 11. While the first 11 and fourth 14 weft yarns, which define the foreground 2 of the first image A and the background of the second image B, are located at the upper plane 18 and define the ridges 20.

When the second area II of the fabric 1 is viewed from either direction indicated by arrows C or D, the valleys 22 are obscured from view by the ridges 20. Since the second weft yarn 12 is located in a valley 22, the second image B is not readily visible from either direction C or D.

When the second area II is viewed from direction C, the side of the ridge 20 defined by the first weft yarn 11 faces the viewer. Thus, image A is visible from direction C. Whereas, when viewing the second area II from direction D, however, the fourth weft yarn 14 defines the side of the ridge 20 facing the viewer. Therefore, the background of the second image B is primarily visible and the first image A is substantially invisible from direction D.

WEAVE STRUCTURE OF AREA III

FIGS. 15 through 19 diagrammatically illustrate the repeating structural unit of the weave pattern in area III of the fabric 1.

As shown in FIG. 1, only image B is contained in the fabric in area III. Therefore, the second 12 and third 13 weft yarns, which respectively define the foreground 3 of the second image B and the background of the first image A, are located in the upper plane 18 and define the ridges 20, see FIGS. 15 and 16. While the first 11 and fourth 14 weft yarns, which define the foreground 2 of the first image A and the background of the second image B, are located in the lower plane 16 and define the valleys 22.

Since the first weft yarn 11 is located in a valley 22, the first image A is not readily visible from either direction C or D.

When the third area III is viewed from direction D, the side of the ridge defined by the second weft yarn 12 faces the viewer. Thus, the second image B is visible from direction D. However, when viewing the second area II from direction C, the third weft yarn 13 defines the side of the ridge 20 facing the viewer. Therefore, the background of the first image A is primarily visible and the second image B is substantially invisible from direction C.

WEAVE STRUCTURE OF AREA IV

FIGS. 20 through 24 diagrammatically illustrate the repeating structural unit of the weave pattern in area IV of the fabric 1.

As shown in FIG. 1, both the first image A and the second image B are contained in the fabric in area IV. Therefore, the first 11 and the second 12 weft yarns, which respectively define the foreground 2 of the first image A and the foreground 3 of the second image B, are located at the upper plane 18 and define the ridges 20, see FIGS. 20 and 21. While the third 13 and fourth 14 weft yarns, which respectively define the backgrounds of the first image A and the second image B, are located at the lower plane 16 and define the valleys 22. Thus the third 13 and fourth 14 weft yarns define the valleys 22 and the first 11 and second 12 weft yarns define the ridges 20.

No matter which direction, C or D, area IV is viewed from, the third and fourth weft yarns 13 and 14 defining the backgrounds of the images A and B are both obscured from view. Therefore, the viewer always sees the foreground 2, 3 of one of images A, B.

When viewing area IV from direction C, the second weft yarn 12 forms the side of the ridge 20 facing the viewer. Thus, if the second image B is a different color than the first image A, then the viewer sees the portion of the first image A in the overlap region, area IV, in a different color than in area II. When viewing area IV from direction D the first weft yarn 11 forms the side of the ridge 20 facing the viewer and the viewer sees the portion of the second image B in the overlap region, area IV, in a different color than in area III.

In order that the valleys are formed deep enough, relative to the peaks of the ridges, it has been found that the warp yarns must have an outer diameter that is at least one half the outer diameter of the weft yarns.

It can be appreciated that the background and foreground of each image can be formed of more than a single color. For example, fabrics have been made using four to eight different colored weft yarns for the backgrounds and four to eight different colored weft yarns for the foregrounds. Moreover, it can be appreciated that the background and foreground of each image may comprise any desired pattern, i.e. striped, paisley, etc.

Although the disclosed preferred embodiment contains an eight weft yarn by eight warp yarn repeat, it can be appreciated that the weave structure can have any desired repeating pattern. It can likewise be appreciated that the number of warp yarns tying down the weft yarns forming the valleys can vary, i.e. two warp yarns may tie down each weft yarn forming a ridge while four tie down each weft yarn forming a valley. As set forth above, it is only critical that the number of warp yarns tying down the warp yarns in the valleys is greater than the number of warp yarns tying down the weft yarns in the ridges.

Preferably the upper plane and lower plane are spaced from one another by a distance of approximately 0.5 mm.

One of the images may consist solely of background with no foreground or illustration. With this construction background only will be visible from one of the directions.

Fabric according to the invention my be used as wall coverings, bed coverings, upholstery, clothing or any other customary use for ornamental fabric. Fabric according to the invention may be used as a wall covering or carpeting in a busy hallway, for example, such that one message or image is visible when walking past the fabric in one direction and another message or image is visible when walking past the fabric in the opposite direction.

Since certain changes may be made in the above described weaving method, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. A process of producing fabric having two images on a front surface thereof, a first of the two images being visible when viewing the front surface at an angle from a first direction and substantially invisible when viewing the front surface at angle from a second direction, and a second of the two images being visible when viewing the front surface from said second direction and substantially invisible from said first direction, said process comprising the steps of:

a) weaving a plurality of parallel ridges, in said front surface, substantially covering said front surface and running perpendicular to said first and second directions;

b) weaving said first image on a first longitudinal side of said ridges, facing said first direction, and weaving said second image on a second longitudinal side of said ridges, facing said second direction.

2. A process according to claim 1, wherein step a) further comprises the steps of weaving alternating upper pairs and lower pairs of weft yarns that run perpendicular to said first and second directions defining said ridges with said upper pairs and defining valleys, between each adjacent pair of said ridges, with said lower pairs.

3. A process according to claim 2, wherein step a) further comprises the steps of weaving a plurality of warp yarns running perpendicularly to said weft yarns on a rear surface of said fabric; and interlacing said warp yarns with said weft yarns in a manner that holds a first plurality of said weft yarns defining said valleys more tightly than a second plurality of said weft yarns defining said ridges.

4. A process according to claim 2, wherein step a) further comprises the steps of interlacing a plurality of warp yarns with said weft yarns, perpendicularly to said weft yarns, in a repeating pattern that repeats every predetermined number of warp yarns and predetermined number of weft yarns; and in each repeat of said pattern, interlacing a greater number of said warp yarns with said lower weft yarns than with said upper weft yarns.

5. A process according to claim 4, wherein said interlacing step further comprises the steps of repeating said pattern every eight said warp yarns and every eight said weft yarns; and in each said repeat, interlacing each of said lower weft yarns with three of said warp yarns and interlacing each of said upper weft yarns one of said weft yarns.

6. A process according to claim 2, wherein step b) further comprises the steps of weaving said first image with a first plurality of said weft yarns that define the sides of said ridges that face said first direction and defining said second image with a second plurality of said weft yarns that define the sides of said ridges that face said second direction.

7. A process according to claim 6, wherein step b) further comprises the steps of weaving said images with a repeating pattern of four weft yarns;

in each repeating pattern of weft yarns:

providing a first weft yarn in a color defining a background of the first image, providing a second weft yarn in a color defining a background of the second image, providing a third weft yarn in a color defining a body of the first image and providing a fourth weft yarn in a color defining a body of the second image;

dividing said fabric into at least three areas, a first area that does not contain either image, a second area that contains the first image only and a third area that contains the second image only;

in said first area, weaving said ridges with said first and second weft yarns and weaving said valleys with said third and fourth weft yarns;

in said second area, weaving said ridges with said second and third weft yarns and weaving said valleys with said fourth and first weft yarns;

in said third area, weaving said ridges with said fourth and first weft yarns and weaving said valleys with said second and third weft yarns.

8. A process according to claim 7, further comprising the steps of dividing said fabric into a fourth area that contains the foreground of both first and second images overlapping;

in said fourth area, weaving said ridges with said third and fourth weft yarns and weaving said valleys with said first and second weft yarns.

9. A fabric having two woven images on a front surface thereof, said fabric comprising:

a plurality of parallel ridges on said first surface that substantially cover said first surface; and said first image being depicted on a first longitudinal side of said ridges, facing a first side of said fabric, said second image being depicted on a second longitudinal side of said ridges, facing a second side of said fabric, remote from said first side of said fabric;

wherein a first of the two images is visible upon viewing the front surface from said first side of said fabric and substantially invisible upon viewing the front surface from said second side of said fabric and a second of the two images being visible when viewing the front surface from said second side of said fabric and substantially invisible from said first side of said fabric.

10. A fabric according to claim 9, further comprising a plurality of parallel, alternating, upper pairs and lower pairs of weft yarns that run substantially perpendicular to said first and second sides, said upper pairs define said ridges and said lower pairs define valleys between each adjacent pair of ridges.

11. A fabric according to claim 10, further comprising a plurality of warp yarns, running perpendicularly to said weft yarns on a rear surface of said fabric, interlaced with said weft yarns; and wherein a greater number of said warp yarns are interlaced with each of said weft yarns defining said valleys than with each of said weft yarns defining said ridges, such that said weft yarns hold said weft yarns defining said valleys more tightly than said weft yarns defining said ridges.

12. A fabric according to claim 11, wherein said warp yarns are interlaced with said weft yarns in a repeating pattern that repeats every eight said warp yarns and every eight said weft yarns; and in each said repeat, each of said weft yarns defining said valleys are interlaced with three of said warp yarns and each of said weft yarns defining said ridges are interlaced with one of said weft yarns.

13. A fabric according to claim 10, wherein a plurality of said weft yarns that define the sides of said ridges that face said first side of said fabric define said first image and a plurality of said weft yarns that define the sides of said ridges that face said second direction define said second image.

14. A fabric according to claim 13, wherein said images are defined by a repeating pattern of four weft yarns;

in each repeating pattern of weft yarns:

a first weft yarn is a color that defines a background of the first image, a second weft yarn is a color that defines a background of the second image, a third weft yarn is a color that defines a body of the first image and a fourth weft yarn is a color that defines a body of the second image;

said fabric is comprised of at least three distinct areas, a first area that does not contain either image, a second area that contains the first image only and a third area that contains the second image only;

in said first area, said ridges are defined by said first and second weft yarns and said valleys are defined by said third and fourth weft yarns;

in said second area, said ridges are defined by said second and third weft yarns and said valleys are defined by said fourth and first weft yarns;

in said third area, said ridges are defined by said fourth and first weft yarns and said valleys are defined by said second and third weft yarns.

15. A fabric according to claim 14, wherein said fabric is further comprised of a fourth area in which the foregrounds of said first and second images overlap;

in said fourth area, said ridges are defined by said third and fourth weft yarns and said valleys are defined by said first and second weft yarns.

16. A fabric having two images on a front surface thereof, said fabric comprising:

a plurality of parallel, alternating, upper pairs and lower pairs of weft yarns that run substantially perpendicular to said first and second sides, said upper pairs define said ridges and said lower pairs define valleys between each adjacent pair of ridges;

a plurality of warp yarns, running perpendicularly to said weft yarns on a rear surface of said fabric, interlaced with said weft yarns;

wherein said images are defined by a repeating pattern of four weft yarns;

in each repeating pattern of weft yarns, a first weft yarn is a color that defines a background of the first image, a second weft yarn is a color that defines a background of the second image, a third weft yarn is a color that defines a body of the first image and a fourth weft yarn is a color that defines a body of the second image;

said fabric is comprised of at least three distinct areas, a first area that does not contain either image, a second area that contains the first image only and a third area that contains the second image only;

in said first area, said ridges are defined by said first and second weft yarns and said valleys are defined by said third and fourth weft yarns;

in said second area, said ridges are defined by said second and third weft yarns and said valleys are defined by said fourth and first weft yarns; and in said third area, said ridges are defined by said fourth and first weft yarns and said valleys are defined by said second and third weft yarns;

wherein a first of the two images is visible upon viewing the front surface from said first side of said fabric and substantially invisible upon viewing the front surface from said second side of said fabric and a second of the two images being visible when viewing the front surface from said second side of said fabric and substantially invisible from said first side of said fabric.

17. A fabric according to claim 16, wherein said warp yarns are interlaced with said weft yarns in a repeating pattern that repeats every eight said warp yarns and every eight said weft yarns; and in each said repeat, each of said weft yarns defining said valleys are interlaced with three of said warp yarns and each of said weft yarns defining said ridges are interlaced with one of said weft yarns.

* * * * *